US006793215B2

(12) United States Patent
Salomon

(10) Patent No.: US 6,793,215 B2
(45) Date of Patent: Sep. 21, 2004

(54) SELF-ADJUSTING SIDE GUIDE FOR A MAIL HANDLING DEVICE

(75) Inventor: James A. Salomon, Cheshire, CT (US)

(73) Assignee: Pitney Bowes Inc., Stamford, CT (US)

( * ) Notice: Subject to any disclaimer, the term of this patent is extended or adjusted under 35 U.S.C. 154(b) by 500 days.

(21) Appl. No.: 10/035,982

(22) Filed: Dec. 24, 2001

(65) Prior Publication Data

US 2003/0127364 A1 Jul. 10, 2003

(51) Int. Cl.[7] ..... B65H 1/00
(52) U.S. Cl. ..... 271/171; 271/145; 271/248
(58) Field of Search ..... 271/171, 145, 271/226, 248

(56) References Cited

U.S. PATENT DOCUMENTS 1,326,334 A * 12/1919 Gaffney ..... 371/167
1,987,803 A * 1/1935 Ryan ..... 271/171
3,539,178 A * 11/1970 Yanagawa ..... 271/117
3,658,320 A * 4/1972 Kuehn ..... 271/144
4,494,746 A * 1/1985 Moser ..... 271/164
4,772,007 A * 9/1988 Kashimura ..... 271/22
5,286,018 A * 2/1994 Rasmussen et al. ..... 271/147
5,292,117 A * 3/1994 Takagi et al. ..... 271/234
6,409,165 B1 * 6/2002 Yamaoka et al. ..... 271/145

* cited by examiner

*Primary Examiner*—Patrick Mackey
(74) *Attorney, Agent, or Firm*—Steven J. Shapiro; Angelo N. Chaclas

(57) ABSTRACT

A self-adjusting side guide for a document-handling machine having a feed deck along which documents are transported is provided. The self-adjusting side guide includes a first member mounted for movement along the feed deck toward and away from the documents; a guide wall mechanism operatively connected to the first member for movement relative to the first member; and a biasing device that applies a biasing force that biases the guide wall into a first position relative to the first member. The side guide operates such that at times when an external force sufficient to move the first member along the feed deck in the direction of the documents is applied to the guide wall mechanism, the guide wall mechanism moves toward the documents against the biasing force from the first position to a second position relative to the first member without any movement of the first member toward the documents.

15 Claims, 3 Drawing Sheets

SELF-ADJUSTING SIDE GUIDE FOR A MAIL HANDLING DEVICE

BACKGROUND OF THE INVENTION

Paper Handling devices are used to transport various types of documents (paper sheets, envelopes, postcards, etc.) to individual document processing stations. One type of processing station includes a printing device that prints information on the documents in a specified location. Accordingly, the proper registration of the document upon delivery to the printing device is very important in order to ensure that printing occurs at the specified location.

A particular paper-handling device where the proper registration of a transported document is very important is a mailing machine. A mailing machine includes a feeder having an input hopper section into which mailpieces are placed. The feeder is part of the overall mailing machine transport system which delivers the mailpieces to a printing device (postage meter) that prints an evidence of postage (postage indicium) and possibly various bar codes on the mailpiece. Such bar codes can include a facer identification mark (FIM) or cryptographically secure data that is used by the postal authority to verify the authenticity of the printed postage indicium. The postal authority typically has very specific requirements as to the printed location of each of the aforementioned pieces of information that may appear on the mailpiece. The specified locations assist the postal authority in having automated equipment that can detect and read each piece of information printed on the mailpiece. Accordingly, delivering the mailpiece to the printing device in a correctly registered orientation is extremely important.

In prior mailing machines, a side guide was used to register mailpieces against a registration wall in the hopper section. These conventional side guides were typically rigidly fastened to a sliding frame and could be moved toward and away from the registration wall. Thus, as mailpieces were placed in the hopper, the side guide was pushed against the outboard edges of the mailpieces until the inboard edges of the mailpieces became registered against the registration wall.

While the prior side guides effectively initially registered the mailpieces in the hopper, it was often the case that the contact between the side guide and the outboard edges of the mailpieces created excessive drag on the mailpieces as the feeder attempted to transport the mailpieces downstream toward the printing device. The excessive drag would cause the mailpieces to become askew relative to the registration wall resulting in mailpieces that were delivered to the printing device in an improperly registered orientation. As a result, the printed matter was not be printed in the proper location on the mailpiece possibly leading to the failure of the information to be detected and read by the postal authority's automated equipment. In a worst case scenario, it was possible that the mailpiece would be delivered to the printing device outside of a "print zone" such that no information would be printed on the mailpiece. This would lead to mailpieces being rejected for lack of postage payment (no printed postage indicium) when indeed the postage meter had accounted for the required postage.

Thus, what is needed is a side guide that can be used to properly register documents and which self-adjusts to eliminate the excessive drag problem discussed above.

SUMMARY OF THE INVENTION

A self-adjusting side guide for a document-handling machine having a feed deck along which documents are transported is provided. The self-adjusting side guide includes a first member mounted for movement along the feed deck toward and away from the documents; a guide wall mechanism operatively connected to the first member for movement relative to the first member; and a biasing device that applies a biasing force that biases the guide wall into a first position relative to the first member. The side guide operates such that at times when an external force sufficient to move the first member along the feed deck in the direction of the documents is applied to the guide wall mechanism, the guide wall mechanism moves toward the documents against the biasing force from the first position to a second position relative to the first member without any movement of the first member toward the documents.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. Like numerals are used in the different Figures to refer to similar components.

DETAILED DESCRIPTION OF THE PREFERRED EMBODIMENTS

Figure 1:
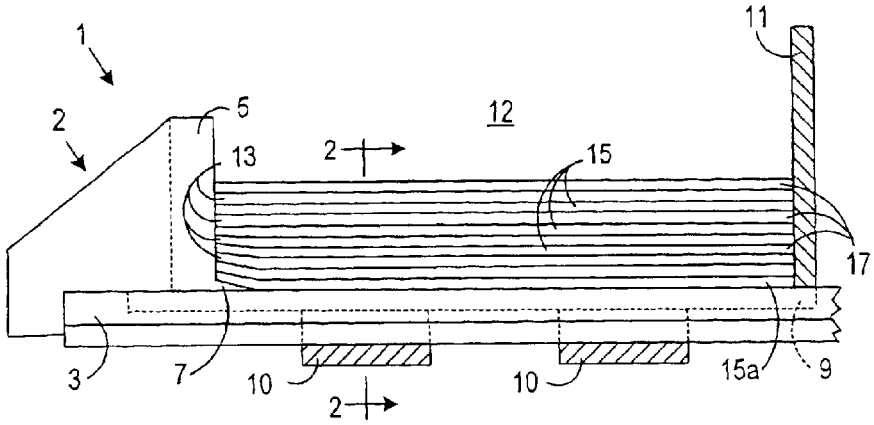
FIG. 1 is a side view, partly in section, of a conventional side guide.

Referring to FIG. 1, portions of a mailing machine 1 having a conventional side guide 2 is shown. The side guide 2 includes a rail 3 and a guide wall 5 that terminates at its bottom end in a ramp configuration 7. The rail 3 rides in a slot 8 of a feed deck 9 of the mailing machine 1 on top of bearing surfaces 10 that extend from the bottom of the feed deck 9. The side guide 2 is movable against the friction force $F_{BS}$ (required to resist motion of mailpieces) created by contact with the bearing surfaces 10 toward and away from a registration wall 11 of the mailing machine 1. The feed deck 9 and the registration wall 11 define the hopper 12.

In the position shown, the guide wall 5 has been pushed against the outboard edges 13 of mailpieces 25 forcing the inboard edges 17 of the mailpieces 15 to be registered against the registration wall 11. The bottommost mailpiece 15*a* rides on the ramp 7 providing a force due to gravity that biases the mailpieces toward the registration wall 12. However, in this position the contact between the guide wall 5 and the outboard edges 13 creates a drag force that may prevent the mailpieces 15 from being fed downstream or cause the mailpieces 15 to become askew relative to the registration wall 11 when the mailpieces 15 are fed downstream.

It has been recognized by the instant inventor that one way to overcome the above problem is to ensure that after the guide wall 5 is used to registers the mailpieces 15 against the registration wall 12 it is moved away from the outboard edges 13 an amount ideally as small as 0.010 to 0.020 inches. However, a retraction of the guide wall 15 up to 0.100 inches is acceptable. This movement of the guide wall 5 would eliminate the drag effect and permit the free feeding of the mailpieces downstream in the properly registered position. However, performing this adjustment manually is not efficient and often requires trial and error by a user in order to effectively position the guide wall 5.

Figure 2:
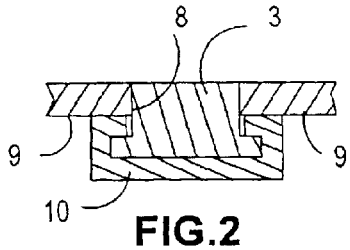
FIG. 2 is a cross-sectional view taken along line 2—2 of FIG. 1.
Figure 3:
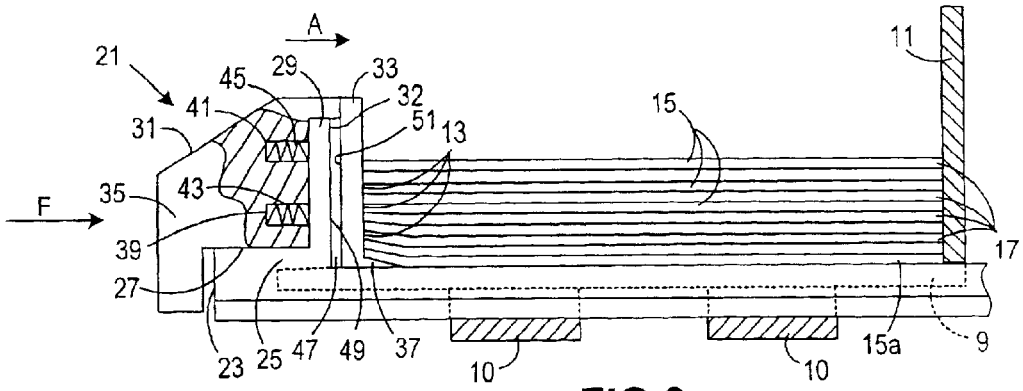
FIG. 3 is a side view, partly in section and partly broken away, of the inventive self-adjusting side guide in a first position in contact with a document stack.
Figure 4:
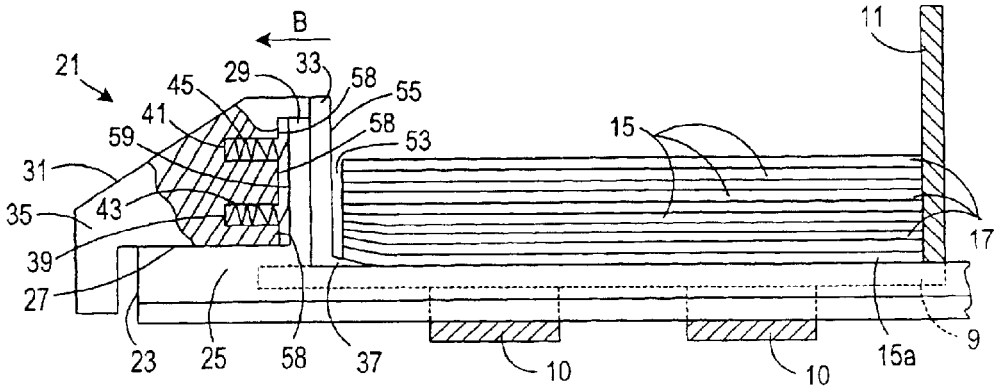
FIG. 4 is a side view, partly in section and partly broken away, of the self-adjusting side guide in a second position out of contact with the document stack.
Figure 5:
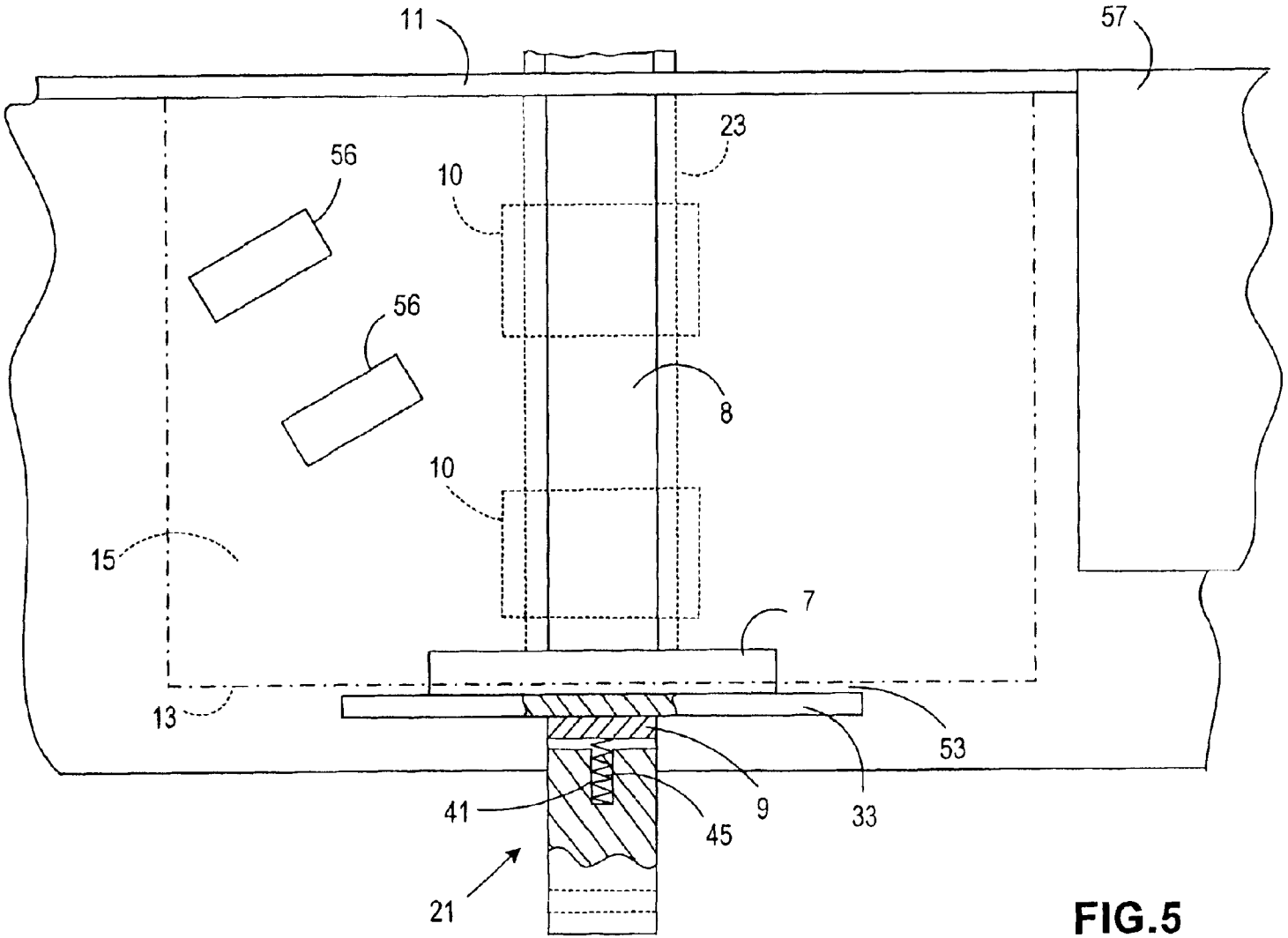
FIG. 5 is a top plan view, partly in section and partly broken away, of the self-adjusting side guide of FIG. 4

By way of reference to FIGS. 2, 3, and 4 one embodiment of the instant invention is shown whereby a side guide 21 that self-adjusts to correct the drag effect problem discussed above is shown. The side guide 21 includes a guide rail 23 rides in the slot 8 of the feed deck 9 on top of the bearing surfaces 10 that extend from the bottom of the feed deck 9. Accordingly, the side guide 21 moves in the same manner as the prior art side guide 2 relative to registering the mailpieces 25 against registration wall 11.

However, unlike the prior art side guides, the guide rail 23 includes an upper angled section 25 made up of a horizontal wall 27 and a vertical wall 29. Further, a guide wall mechanism 31 includes an inverted u-shaped channel 32 therein that divides the guide wall mechanism 31 into a guide wall 33 and a rear housing 35. The guide wall 33 terminates in a ramp 37 upon which the bottom mailpiece 15*a* in the hopper 12 rests.

The guide wall mechanism 31 is positioned such that the vertical wall 29 fits into the inverted unshaped channel 32 and the rear housing 35 rests on the horizontal wall 27 to provide stability to the guide wall mechanism 31 while allowing it to float relative to the vertical wall 29 as discussed further below. The rear housing 35 has two cavities 39, 41 that respectively house springs 43, 45. The springs 43, 45 are captured between the cavities 39, 41 and the vertical wall 29 and create a biasing force $F_B$ that tends to bias the guide wall mechanism 31 away from the vertical wall 29.

Specifically referring to FIG. 2, the guide wall mechanism 31 is shown as having been moved, due to the application of an external force F, in the direction of arrow "A" into contact with the outboard edges 13 of the mailpieces 15 such that the inboard edges 17 are registered against the registration wall 11. In this position a gap 47 of between 0.010 to 0.020 inches (preferably 0.015 inches) exists between a front surface 49 of vertical wall 29 and a rear surface 51 of guide wall 33. However, once the external force F is removed, the biasing force of springs 43, 45 forces the guide wall mechanism 31 to move in the direction of arrow "B" until the rear surface 51 contacts the front surface 49. In this position, a gap 53 now exists between the outboard edges of the mailpieces 15 and a front surface 55 of guide wall 33. The gap 53 ensures that the front surface 55 of guide wall 33 does not create a drag force on the properly registered mailpieces 15 such that they are free to be fed in a properly registered orientation downstream.

When a new set of mailpieces 15 are subsequently placed in the hopper, the guide mechanism of FIG. 3 will be moved to the position of FIG. 2 under the force F in order to register the new mailpieces 15 against the registration wall 11. In order for the guide mechanism 31 to properly operate, the following force relationship must exist:

$$F>F_{BS}>F_B$$

That is, when the external force F is applied to the side guide mechanism 31, it will first overcome the force $F_B$ so that the side guide mechanism 31 will move from the position of FIG. 3 to that of FIG. 2 without any corresponding movement of the guide rail 23. However, once the shoulder portions 57 of rear housing 35 contact vertical wall 29, the external force F overcomes the force $F_{BS}$ so that the entire side guide mechanism 21 will move together toward the registration wall 12 until the mailpieces 15 are forced into registration against the registration wall.

Figure 6:
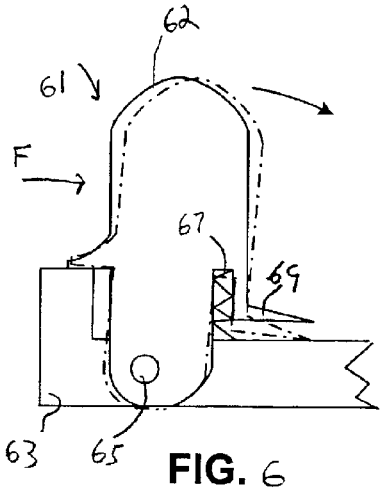
FIG. 6 is a side view of a second embodiment of a self-adjusting side guide.

FIG. 6 shows a side guide 61 including a handle 62 attached to a slide rail 63 at a pivot point 65. A spring 67 biases the handle 62 into the position shown in solid line. When registration of mailpieces is required, a force F is applied to handle 62 causing the handle 62 to pivot to its dotted line position. Since ramp portion 69 now contacts slide rail 63 further application of force F causes the slide rail 63 to move to permit handle 62 to register the mailpieces in a manner previously described. Once the Force F is removed, the handle 62 returns under the force of spring 67 to the solid line position.

Figure 7:
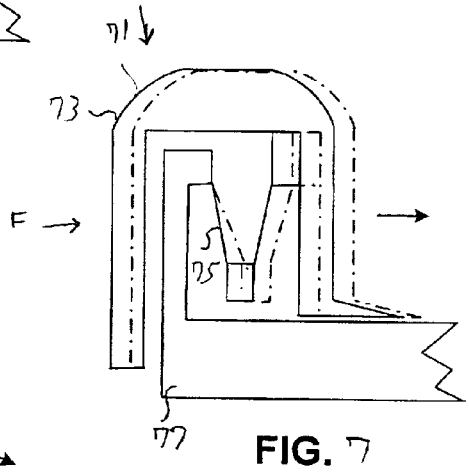
FIG. 7 is a side view of a third embodiment of a self-adjusting side guide.

FIG. 7 shows a side guide 71 including a handle 73 connected via a flexure mechanism 75 to slide rail 77. As the force F is applied the handle 73 will move relative to the slide rail 77 as shown by the dotted line figure. The handle 73 will move until portion 78 thereof contacts portion 79 of slide rail 77. At this point in time the entire slide rail 77 moves to register the mailpieces. Once the force F is removed, the handle 73 returns to the solid line position.

Figure 8:
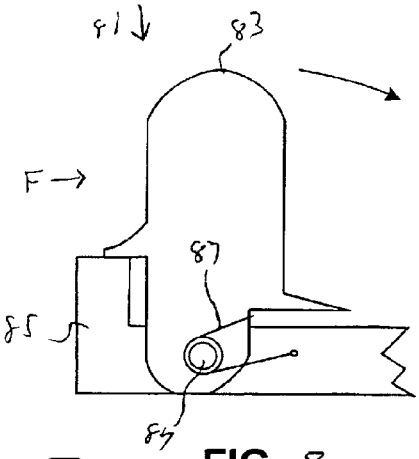
FIG. 8 is a side view of a fourth embodiment of a self-adjusting side guide.

FIG. 8 shows a side guide mechanism 81 having a handle 83 pivotally mounted at point 84 to slide rail 85. Coil spring 87 biases the handle 83 in the position shown into the position shown in FIG. 8. Spring 87 acts in the same manner as spring 67 of FIG. 6 with respect to the movement and retraction of handle 83 relative to slide rail 85.

Figure 9:
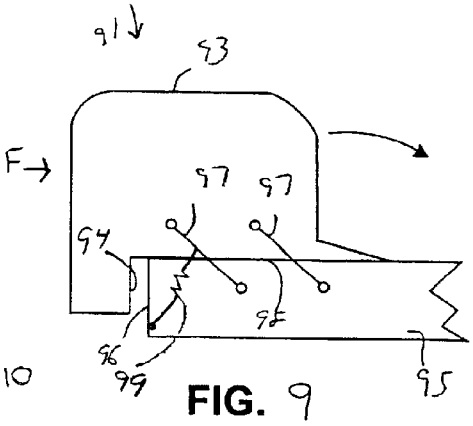
FIG. 9 is a side view of a fifth embodiment of a self-adjusting side guide.

FIG. 9 shows a side guide 91 having a handle 93 that is connected to slide rail 95 via a four bar linkage system 97 (only two shown—other side has two bars). While the links 97 pivot about their connections on the slide rail 95, the handle 93 moves up and toward the mailpiecess when force F is applied. The handle 93 during its movement always maintains its planar surface 98 in a parallel orientation relative to slide rail 95. The handle 93 moves until its back end 94 contacts the rear end 96 of slide rail 95 at which point the slide rail 95 and handle 93 move together toward the mailpieces. Spring 99 returns the handle 93 to the position of FIG. 9 upon removal of force F.

Figure 10:
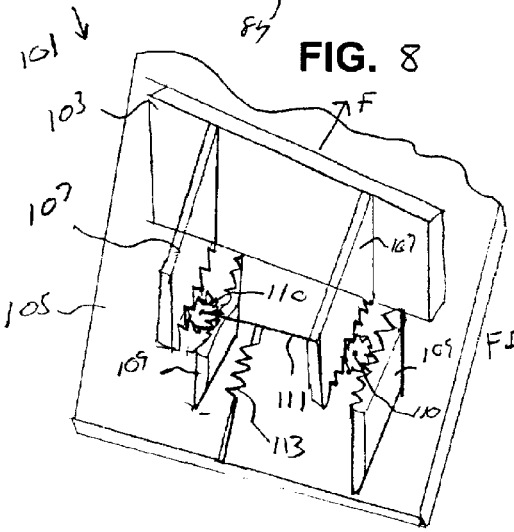
FIG. 10 is a perspective view of a sixth embodiment of a self adjusting side-guide.

FIG. 10 shows yet another side guide 101 having a handle 103 and a rack and pinion system including rack components 107, 109 and pinions 110 connected via a shaft 111. The upper rack portions 107 are attached to the handle 103 and the lower rack portions 109 are attached to slide rail 105. When a force F is applied to the handle 103 its moves toward the mailpieces via the rack and pinion system while the slide rail 105 remains stationary. However, when the rack and pinion system reaches the end of the track, the handle 103 and rail 105 move together and into engagement with the mailpieces. Spring 113 returns the handle 103 to its original position upon the removal of force F.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example, the springs 43, and 45 can be any type of spring such as a leaf spring or any other device such as an elastomeric material that provides the desired biasing force. Moreover, one having ordinary skill in the art will recognize that the springs, rail, guide wall mechanism can be configured in many different orientations and forms in order to achieve the basic effect whereby the guide wall mechanism is free to float over a specified range relative to rail. Moreover, a visible indicator can be included on ramp 37 which the operator can use to ensure that the side guide has retracted the required minimum amount.

What is claimed is:

1. A self-adjusting side guide for a document-handling machine having a feed deck along which documents are transported comprising:

a first member mounted for movement along the feed deck toward and away from the documents;

a guide wall mechanism operatively connected to the first member for movement relative to the first member; and a biasing device that applies a biasing force that biases the guide wall into a first position relative to the first member;

wherein at times when an external force sufficient to move the first member along the feed deck in the direction of the documents is applied to the guide wall mechanism, the guide wall mechanism moves toward the documents against the biasing force from the first position to a second position relative to the first member without any movement of the first member toward the documents.

2. A self-adjusting side guide as recited in claim 1, wherein at times when the guide wall mechanism is in the second position and the external force continues to be applied the guide wall mechanism and the first member move together toward the documents.

3. A self-adjusting side-guide as recited in claim 2, wherein at times when the guide wall mechanism and the first member are being moved together by the external force and the external force is subsequently removed the first member becomes stationary relative to the feed deck and the guide wall mechanism is returned to the first position by the biasing device.

4. A self-adjusting side guide as recited in claim 3, wherein a distance between the first and second positions is between about 0.010 inches to 0.020 inches.

5. A self-adjusting side guide as recited in claim 4, wherein the biasing device includes at least one spring disposed between the guide wall mechanism and the first member.

6. A self-adjusting side guide as recited in claim 4, wherein the guide wall mechanism includes a channel therein that divides the guide wall mechanism into a guide wall and a rear housing and the first member extends into the channel.

7. A self-adjusting side guide as recited in claim 5, wherein the biasing device is at least one spring disposed between the rear housing and the first member.

8. A self-adjusting side guide as recited in claim 7, wherein the rear housing has a cavity within which the at least one spring is disposed.

9. A self-adjusting side guide as recited in claim 6, wherein when the guide wall mechanism is in the first position the guide wall abuts against the first member and when the guide wall is in the second position the guide wall abuts against the rear housing.

10. A self-adjusting side guide as recited in claim 9, where the first member is an L-shaped rail having a first leg horizontal to the feed deck and a second leg orthogonal to the first leg, the second leg extending into the channel.

11. A self-adjusting side guide as recited in claim 3, wherein the biasing device is first and second springs each disposed between the guide wall mechanism and the first member.

12. A self-adjusting guide as recited in claim 11, wherein the guide wall mechanism includes a channel therein that divides the guide wall mechanism into a guide wall and a rear housing and the first member extends into the channel.

13. A self-adjusting side guide as recited in claim 12, wherein the rear housing has first and second cavities within which the first and second springs are respectively disposed.

14. A method for registering documents on a feed deck against a registration wall comprising the steps of:

providing a side guide having a first member mounted for movement along the feed deck toward and away from the documents, a guide wall mechanism operatively connected to the first member for movement relative to the first member; and a biasing device that applies a biasing force that biases the guide wall into a first position relative to the first member;

applying a force to the guide wall mechanism that moves the guide wall mechanism against the biasing force toward the documents from the first position and into a second position relative to the first member without a corresponding movement of the first member toward the documents;

continuing to apply the force to the guide wall at the second position so that the first member and the guide wall move together toward the registration wall contacting the documents and registering the documents against the registration wall; and removing the force from the guide wall when the documents are registered thereby permitting the biasing device to move the guide wall mechanism from the second position to the first position creating a gap between the documents and the guide wall.

15. A method as recited in claim 11, wherein the gap is created to be in a range of about 0.010 inches to 0.020 inches.

* * * * *